US010373507B2

(12) United States Patent
Marcella et al.

(10) Patent No.: US 10,373,507 B2
(45) Date of Patent: Aug. 6, 2019

(54) SYSTEM AND METHOD FOR CALCULATING ESTIMATED TIME OF RUNWAY LANDING AND GATE ARRIVAL FOR AIRCRAFT

(71) Applicant: PASSUR Aerospace, Inc., Stamford, CT (US)

(72) Inventors: Matthew Marcella, Stamford, CT (US); Thomas White, Stamford, CT (US)

(73) Assignee: PASSUR Aerospace, Inc., Stamford, CT (US)

( * ) Notice: Subject to any disclaimer, the term of this patent is extended or adjusted under 35 U.S.C. 154(b) by 39 days.

(21) Appl. No.: 15/044,756

(22) Filed: Feb. 16, 2016

(65) Prior Publication Data

US 2016/0240090 A1 Aug. 18, 2016

Related U.S. Application Data

(60) Provisional application No. 62/116,114, filed on Feb. 13, 2015.

(51) Int. Cl.
*G08G 5/06* (2006.01)
*G08G 5/02* (2006.01)

(52) U.S. Cl.
CPC ..... *G08G 5/065* (2013.01); *G08G 5/025* (2013.01)

(58) Field of Classification Search
CPC ..... G08G 5/065; G08G 5/025; G08G 5/0013; G08G 5/0043; G08G 51/096888; G01C 23/005; G01C 21/36; G01C 21/3446; G01C 21/34; G01C 21/3617; G06F 17/30017; G06Q 10/0639; H04W 4/028
USPC ..... 701/424, 521
See application file for complete search history.

(56) References Cited

U.S. PATENT DOCUMENTS

| | | | | |
|---|---|---|---|---|
| 8,140,199 | B2 * | 3/2012 | Barry | G01C 23/005 340/945 |
| 2012/0179368 | A1 * | 7/2012 | Walter | G01C 21/20 701/465 |
| 2013/0110392 | A1 * | 5/2013 | Kosseifi | G01C 21/3415 701/410 |
| 2014/0012634 | A1 * | 1/2014 | Pearlman | G09B 19/14 705/7.42 |
| 2016/0093217 | A1 * | 3/2016 | Hale | G08G 5/0026 701/120 |
| 2016/0189080 | A1 * | 6/2016 | Liao | G06Q 10/025 705/7.39 |

* cited by examiner

*Primary Examiner* — Abby Y Lin
(74) *Attorney, Agent, or Firm* — Fay Kaplun & Marcin, LLP

(57) ABSTRACT

A system and method for dividing a flight path into flight segments, wherein the flight path comprises a route between an aircraft takeoff and a runway landing; receiving a historic transit time and real-time transit time of a target aircraft class, for each flight segment of a current flight; determining a differential time for each flight segment by comparing the real-time transit time and the historic transit time; applying the differential time to each flight segment to adjust an estimated transit time for each flight segment; determining an estimated ON time for the aircraft by adding together all of the estimated transit times from each flight segment of the flight path; and determining an estimated IN time for the aircraft based on the estimated ON time and an estimated ON to IN time. The system includes a calculation engine for performing the steps of the calculation.

20 Claims, 6 Drawing Sheets

ETA Historic Component Estimation Method (400)

SYSTEM AND METHOD FOR CALCULATING ESTIMATED TIME OF RUNWAY LANDING AND GATE ARRIVAL FOR AIRCRAFT

PRIORITY CLAIM/INCORPORATION BY REFERENCE

The present application claims priority to U.S. Provisional Patent Application 62/116,114 filed on Feb. 13, 2015 entitled "System and Method for Calculating Estimated Time of Runway Landing and Gate Arrival for Aircraft" naming Matthew Marcella and Thomas White as inventors, and hereby incorporates, by reference, the entire subject matter of this Provisional Application.

BACKGROUND INFORMATION

The estimated time of arrival or ETA is a measure of when an aircraft is expected to arrive at a certain place. For aircraft, there may be various ETAs that are used by both the airline and the traveling public. For example, one ETA may be a prediction of when the aircraft will land on a runway. This estimated landing time is sometimes referred to as the estimated ON time. Another ETA may be when the aircraft will reach the gate at which it is to discharge or board its passengers. This estimated gate arrival time is sometimes referred to as the estimated IN time. This ETA information is used by the airline to inform its passengers and other persons (e.g., the persons picking up the passengers) so that people do not waste time waiting for an aircraft by planning when to arrive at the airport. In addition, the airline may also use this information for a variety of other reasons, e.g., to schedule gate employees, to ensure that a gate is available for an incoming flight, etc.

SUMMARY

A method including dividing a flight path into flight segments, wherein the flight path comprises a route between an aircraft takeoff and a runway landing, receiving a historic transit time and real-time transit time of a target aircraft class, for each flight segment of a current flight, determining a differential time for each flight segment by comparing the real-time transit time and the historic transit time, applying the differential time to each flight segment to adjust an estimated transit time for each flight segment, determining an estimated ON time for the aircraft by adding together all of the estimated transit times from each flight segment of the flight path and determining an estimated IN time for the aircraft based on the estimated ON time and an estimated ON to IN time.

A system having an input receiving a historic transit time for an aircraft, an input receiving a real-time transit time for an aircraft, wherein the inputs are from a target aircraft class, and further wherein each input is received for each flight segment of a current flight and a calculation engine. The calculation engine dividing a flight path of the current flight into flight segments, wherein the flight path comprises a route between an aircraft takeoff and a runway landing, determining a differential time for each flight segment by comparing the real-time transit time and the historic transit time, applying the differential time to each flight segment to adjust an estimated transit time for each flight segment, determining an estimated ON time for the aircraft by adding together all of the estimated transit times from each flight segment of the flight path, and determining an estimated IN time for the aircraft based on the estimated ON time and an estimated ON to IN time.

A non-transitory computer readable storage medium storing a set of instructions that are executable by a processor. The instructions being operable to cause the processor to divide a flight path into flight segments, wherein the flight path comprises a route between an aircraft takeoff and a runway landing, receive a historic transit time and real-time transit time of a target aircraft class, for each flight segment of a current flight, determine a differential time for each flight segment by comparing the real-time transit time and the historic transit time, apply the differential time to each flight segment to adjust an estimated transit time for each flight segment, determine an estimated ON time for the aircraft by adding together all of the estimated transit times from each flight segment of the flight path and determine an estimated IN time for the aircraft based on the estimated ON time and an estimated ON to IN time.

DETAILED DESCRIPTION

Figure 1:
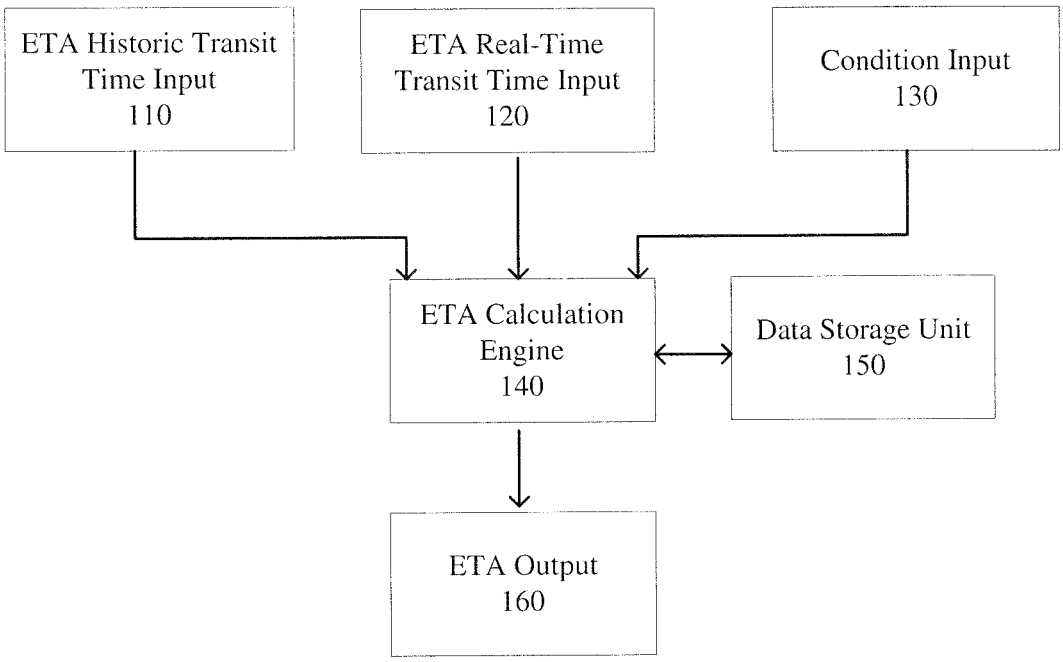
FIG. 1 shows an exemplary ETA system 100 for estimating an aircraft runway landing time (ON time) or gate arrival time (IN time) according to the exemplary embodiments.

The exemplary embodiments may be further understood with reference to the following description of the exemplary embodiments and the related appended drawings, wherein like elements are provided with the same reference numerals. The exemplary embodiments are related to systems and methods for predicting times of aircraft runway landing (ON time) and gate arrival (IN time) based on flight segment transit times.

The exemplary embodiments provide a comprehensive estimate of ON time by dividing the total flight path of a current flight into flight segments. The transit time for traveling each segment is estimated by comparing a current flight segment to the same flight segment with matching aircraft class, flight path, etc., and will be further estimated based on conditions affecting the ON time. This way, the data from completed flight segments of recent flights in progress, which could affect an ON time, may be taken into consideration in estimating the ON time, even before the entire flight is complete.

Thus, exemplary embodiments provide an estimated time of aircraft landing on the runway (ON time) and arrival at the gate (IN time), based on the estimated transit time for each flight segment. These estimated ON and IN times may also be referred to as the extended Estimated Time of Arrival (X-ETA).

In formula form, the extended ETA of interest for the exemplary embodiments may be expressed as follows:

$$\text{Extended ETA} = \text{Estimated Transit Time}_{\text{Flight Segment 1}} + \text{Estimated Transit Time}_{\text{Flight Segment 2}} + \text{Estimated Transit Time}_{\text{Flight Segment 3}} \quad \text{a.}$$

That is, the extended ETA is the sum of the estimated transit times for each of the flight segments that make Up the overall flight path. The exemplary embodiments are directed to systems and methods for estimating the ON time and IN time, by dividing the total flight path into flight segments of approximately equal distance, and estimating the transit time of each flight segment to provide a continuously updated, cumulative estimated ETA based on historic and real-time estimated transit times for each flight segment.

FIG. 1 shows an exemplary ETA system 100 according to the exemplary embodiments. The ETA system 100 includes an estimated historic transit time input 110, calculated on the basis of actual past performance transit times in the same aircraft class as the current flight. The calculation of the estimated historic transit time input 110 is described in further detail below, and depicted in FIG. 4. A second input, to the ETA system 100 is a real-time transit time input 120, which comprises the real-time transit times in the same aircraft class as the current flight. For example, a real-time transit time is a transit time for a flight segment of the current flight. The real-time transit time input 120 is described in steps 520-530 in further detail below, and depicted in FIG. 5. A third input to the ETA system 100 is a condition input 130, which is any number of conditions for the aircraft or airport, which are used to estimate an aircraft's ON or IN time. Exemplary conditions that may be used to estimate an aircraft's ON or IN time are provided below. It is noted that while the condition input 130 is shown as a single input, the conditions that are used to estimate an aircraft's ON or IN time may, in fact, come from a variety of sources. Likewise, the historic and real-time transit time inputs 110 and 120 may also come from a variety of sources.

The ETA system 100 also includes an ETA calculation engine 140 and a data storage unit 150. The calculations performed by the ETA calculation engine 140 will be described in greater detail below. In general, the data from inputs 110, 120, and 130, alone or in combination with data stored in data storage unit 150, is used to calculate the extended ETA according to the formula described above. The ETA calculation engine 140 will provide the results of the ETA calculations to an ETA output device 160 for use by the user. The ETA output device 160 may be, for example, a display device, a printer, etc., or may simply be an output to another related system that then provides a display of the ETA, (e.g. an airline's system for displaying flight status at a particular airport.)

The data storage unit 150 stores the data that input from the data inputs 110, 120, and 130, and also stores historical data including previous ETA calculations, previous transit time calculations, previous aircraft and airport conditions, and data on past performance, such as historic transit times. The data storage unit 150 may be, for example, a non-transitory storage medium that both stores the data described above and stores lines of code that may be executed by a processor to perform some or all of the functionalities described herein for the ETA system 100. It is also noted that the manner of storing the data may be in any known way, such as, a database, a table, an array, etc.

In one exemplary embodiment, the ETA calculation engine 140 may be embodied as a processor executing lines of code that operates to perform the calculations described herein. For example, the ETA system 100 may be embodied on a server device that is used to control airport operations and displays. The server device may have a memory storing the data that is input via inputs 110, 120, and 130, and instructions for performing the calculations of the calculation engine 140, a processor for executing the instructions stored in the memory, and an output component to output the results of the calculations.

The server computer may be multiple networked devices to which users have network or Internet access. Thus, a user may remotely access the ETA system 100 to perform the ETA calculations and/or view the results of the ETA calculations.

In an exemplary embodiment, different conditions that may be input from condition input 130 and may be considered when estimating the ON or IN time include, for example: aircraft class, weather, flight route, actual flight path, air traffic, controllers' actions, airport delays, runway or airspace configuration, flight trajectory including diversion or holding patterns, wind, time of day, day of week, airspace congestion, FAA controlled factors or speeds, etc. Weather conditions could include wind, wind speed, weather fronts, route changes due to weather, etc. Those of skill in the art will understand that other conditions may also be used and the above conditions are only exemplary.

The actual ON or IN times for all the aircraft associated with the conditions of condition input 130 may be collected and used for estimation purposes. This data on conditions input from condition input 130 may be stored by data storage unit 150, for example, in a look-up table, or any other structure suitable for storing data, and then may be used by the ETA calculation engine 140 to estimate the ON or IN time for any particular aircraft. Those skilled in the art will understand that there are multiple ways of using the stored data to estimate the ON or IN time for an aircraft. In a first example of estimating the historic transit time input 110, an exact match of predicted forecast conditions may be searched. This method 400 of estimating an ETA historic component is described further with respect to FIG. 4 below. For example, an aircraft may be predicted to land on the north end of Runway 1A on Monday at 4:05 pm and is assigned gate 56. The ETA system 100, may search for these exact, stored forecast conditions to determine if past aircraft performance matches these conditions. If a day of week-specific and time-specific match is found, the actual past performance or historic transit times are used to estimate the runway configurations, airspace capacity, and runway capacity for the current flight, and subsequently, the ETA for the current flight.

Meanwhile, the use of a real-time transit time input 120 in combination with a historic transit time input 110 can also be used to calculate the extended ETA. Other methods of using the stored data for ETA estimation purposes may be used. For example, in method 500 of calculating an ETA real-time component, a combination of the input historic transit times through averaging or other statistical methods for transit times in recent history (within one to two years of the current flight) may be performed. The input real-time transit times and combined input historic transit times could then be used in calculating the extended ETA. This method 500 example of using the stored data to calculate an ETA real-time component is described below in more detail, with respect to FIG. 5.

Figure 2:
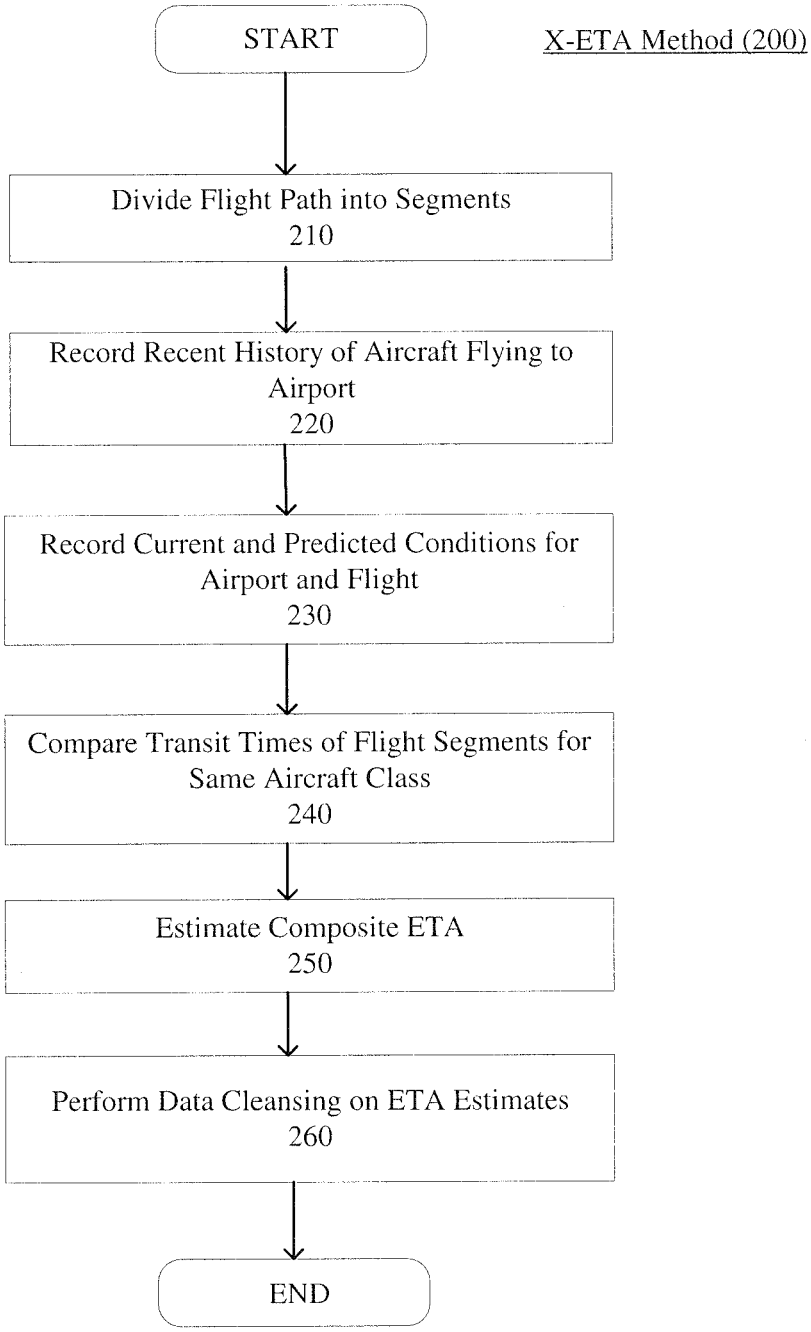
FIG. 2 shows an exemplary general ETA method 100 of estimating the time from aircraft takeoff to landing on the runway (ON time), according to the exemplary embodiments.

FIG. 2 shows an exemplary method 200 of estimating the extended ETA for an aircraft. In particular, FIG. 2 depicts a general method 200 of estimating the time of an aircraft arrival on the runway (ON time), e.g. from the historic transit time input 110 and the real-time transit time input 120. In step 210, the total flight path from takeoff to aircraft landing (ON time) is divided into multiple flight segments of approximately equal distance. The division of a flight path 300 into multiple flight segments (310, 320, 330, and 340) is depicted in further detail in FIG. 3. It should be noted that it is not required that the flight segments have equal distances. Flight segments may be determined based on other factors, such as location of radar installation, beacons, etc.

Figure 3:
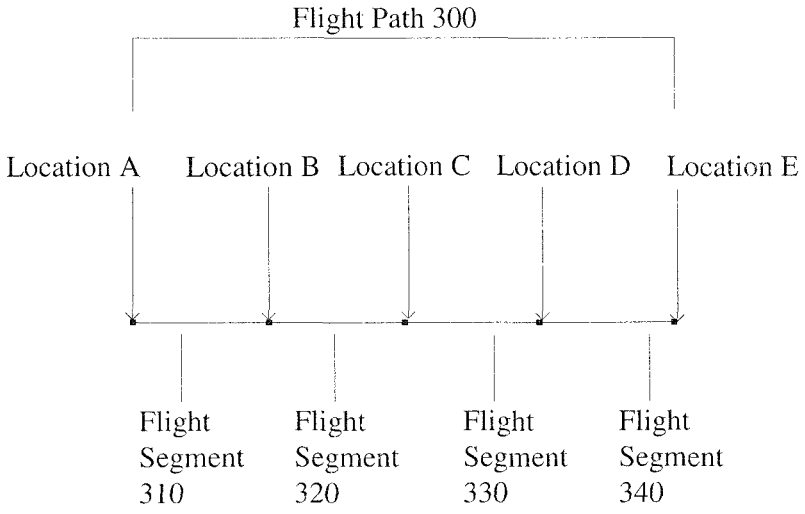
FIG. 3 shows an exemplary flight path 300 between exemplary location A to exemplary location E, where the flight path 300 is divided into flight segments 310, 320, 330, and 340, according to an exemplary embodiment.

FIG. 3 shows an exemplary flight path 300 from aircraft takeoff at exemplary location A to aircraft landing at location E, where the overall flight path 300 is divided into flight segments 310, 320, 330, and 340. Each of the flight segments (310, 320, 330, and 340) has approximately the same distance. The estimation of the transit times for each of the flight segments is discussed further below, with respect to FIGS. 4 and 5. The cumulative sum of the distances of the flight segments is equal to the distance of the entire flight path 300.

Referring back to FIG. 2, in step 220, the ETA system 100 receives data on various conditions affecting flight arrival time (ETA) during recent history, for example, within one to two weeks of the current flight, of aircraft flying to an airport or a nearby airport. The ETA system 100 receives these conditions in step 220, e.g., via real-time transit time input 120 and condition input 130. Examples of these conditions could include aircraft class, weather, flight route, actual flight path, air traffic controllers' actions, airport delays, runway or airspace configuration, flight trajectory including diversion or holding patterns, wind, time of day, day of week, airspace congestion, FAA controlled factors or speeds, etc. Weather conditions include wind, wind speed, weather fronts, route changes due to weather, etc.

In step 230, the current and predicted airport and flight conditions that affect flight arrival time are recorded, e.g., via historic transit time input 110 and condition input 130. As noted above, examples of these conditions include aircraft class, weather, flight route, actual flight path, air traffic controllers' actions, airport delays, runway or airspace configuration, flight trajectory including diversion or holding patterns, wind, time of day, day of week, airspace congestion, FAA controlled factors or speeds, etc. Runway configuration is the setup of the active runways that an airport operates at a specified time. Airspace configuration comprises the parameters of the flight routes designated by flight authorities, including flight path, flight direction, altitude, etc.

In step 240, the transit times for flight segments from multiple types of aircraft within a single aircraft class are compared. Transit time is the time it takes an aircraft to travel the length of a flight segment. For example, the recent historic transit time for a first flight segment is compared with the real-time (current) transit time for the first flight segment. This comparison of historic and real-time transit times is repeated for multiple flight segments, from the same aircraft class. The comparison is used to estimate transit times for each flight segment of the current flight. Aircraft classes are categorized on the basis of similar flight profiles. For example, aircraft from the same aircraft class could have similar engine type, similar aircraft maximum takeoff weight, and similar aircraft maximum landing weight.

In step 250, the composite ETA for the entire flight path is estimated, by combining the estimated transit times from each flight segment. The cumulative combined distances of the flight segments is equal to the distance of the total flight path.

In step 260, data cleansing of flight data, including ETA estimates, is performed to increase the accuracy of ETA estimates. Data cleansing is the removal of data noise caused by faulty radar indications or data noise from flight segments with holding loops caused by congestion. Data cleansing is performed on flight segments with holding loops caused by congestion because holding patterns frequently disappear once the target aircraft arrives at the prior holding area. Next, the estimated composite ETA may be output to ETA output 160.

Figure 4:
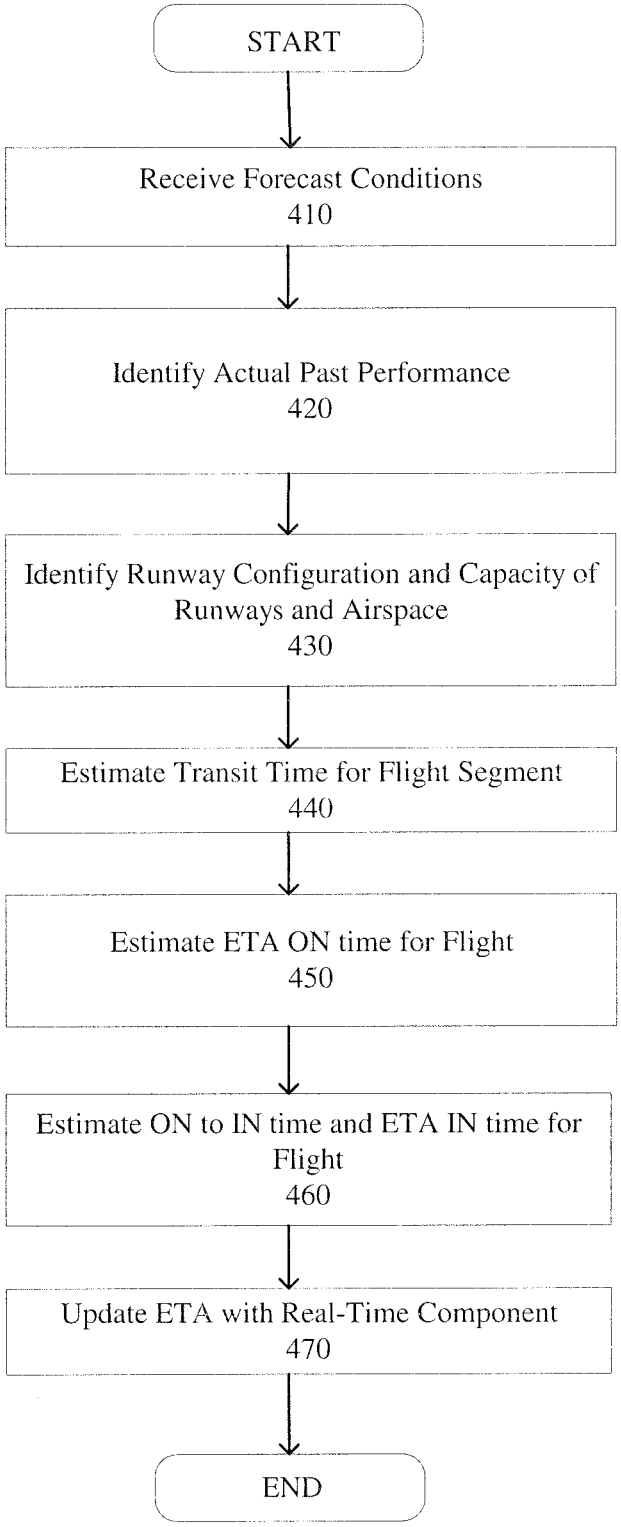
FIG. 4 depicts a method 400 for estimating the historic component of the ETA for an aircraft, according to an exemplary embodiment.

FIG. 4 depicts a method 400 for estimating the historic component of the ETA of the current flight. Method 400 estimates the time from aircraft takeoff to aircraft landing on the runway (ON time), and estimates the time from aircraft takeoff to aircraft arrival at the gate (IN time). In step 410, the forecast conditions are received, e.g. via condition input 130. The forecast conditions are conditions that are predicted to affect flight arrival time (ETA) for the current flight. As noted above with respect to FIG. 1, examples of these conditions could include aircraft class, weather, flight route, actual flight path, air traffic controllers' actions, airport delays, runway or airspace configuration, flight trajectory including diversion or holding patterns, wind, time of day, day of week, airspace congestion, FAA controlled factors or speeds, etc. Weather conditions could further include wind, wind speed, weather fronts, route changes due to weather, etc.

In step 420, based on the received conditions, the actual past performance of the same aircraft class as the current flight, for the same time of day and same day of the week, is identified. The conditions are matched to the past performance of the same aircraft class. Past performance could include historic transit times for flight segments.

Next, in step 430, based on the matching between the forecast conditions and the past performance, the runway configurations, runway capacity, and airspace capacity are identified for the current flight. In particular, the runway configurations, runway capacity, and airspace capacity for the current flight are identified on the basis of these matches, specific for the same time of day and same day of the week.

In step 440, a transit time for each flight segment of the current flight is estimated, e.g. via the ETA calculation engine 140, on the basis of factors including: the time and day of the past performance, along with past performance that matched the forecast conditions, and the runway configurations, runway capacity, and airspace capacity identified for the current flight.

In step 450, the estimated ETA ON time for the current flight is estimated by adding-up the estimated transit times of each flight segment, e.g. via the ETA calculation engine 140.

In step 460, the estimated ETA IN time is calculated by adding the estimated ON time to the estimated ON to IN time, e.g. via the ETA calculation engine 140, according to the following formula:

$$\text{ETA IN time} = \text{Estimated ON time} + \text{Estimated ON to IN time}$$

In step 460, initially, the ON to IN time is estimated using a database look-up table function comprised of prior ON to IN times, e.g. via the ETA calculation engine 140. First, the ETA system 100 searches for the ON to IN times from past flights that match the conditions of the current flight, including time of day, runway, gate proximity, and time of year, etc. Gate proximity is a collection of nearby gates with similar aircraft taxi times from the aircraft landing location. Second, the median ON to IN time of the matching past flights is calculated, e.g. via the ETA calculation engine 140. In addition, recent historic flights are evaluated, e.g. via the ETA calculation engine 140, to determine the airport's recent on-time flight performance relative to the average airport performance. This determination is used to adjust the median ON to IN time according to the airport's recent flight performance. The adjusted median ON to IN time is added to the estimated ON time, to estimate the ETA IN time.

In step 470, after the current flight begins at the aircraft takeoff, and the flight becomes active, the ETA ON and IN times of the current flight are continuously updated by inputting the historic transit times from step 420 into the method 500 for estimating the real-time ETA component, which is described in more detail below. In this continuous update of the ETA estimates, all steps of method 500, including steps 510-580, are performed.

Figure 5:
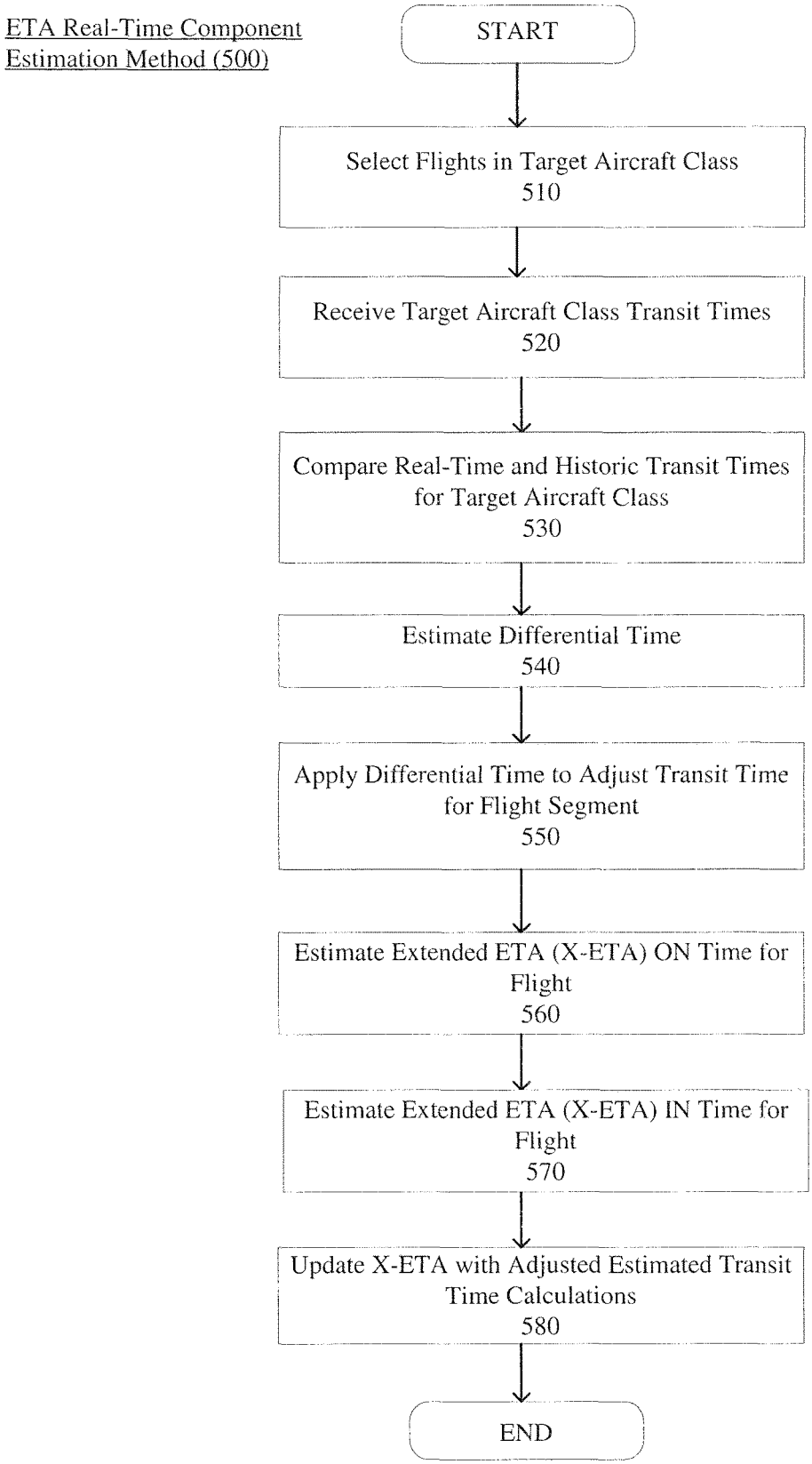
FIG. 5 depicts a method 500 of estimating the real-time (current flight) component of the ETA for an aircraft, according to an exemplary embodiment.

FIG. 5 depicts a method 500 of estimating the real-time component of the ETA for the current flight. Method 500 estimates the time from aircraft takeoff to ON time and IN time. In step 510, flights from the same target aircraft class are selected. The target aircraft class includes flights in the same aircraft class, on the same flight path and same altitude range as the current flight. As discussed above, aircraft in the same aircraft class could have similar engine type, similar aircraft maximum takeoff weight, and similar aircraft maximum landing weight.

In step 520, both the historic and real-time transit times for each flight segment of the current flight and the target aircraft class are received, e.g. via historic transit time input 110 and real-time transit time input 120. Historic flights are flights that occurred within recent history, for example, within the last one or two years, of the current flight. Historic flights may also include flights on the same day as the current flight, and data on these more recent same-day flights may be have more weight in the ETA calculations. In addition, "real-time" data may be used to refer to data from the current flight. The historic transit times from step 420 for a given period, for example, the one-year period preceding the current flight, may be combined, according to statistical methods or averaging, etc., to provide a single historic transit time for each flight segment. This single historic transit time may be referred to as the median historic transit time. The real-time transit times for each flight segment are the transit times for each flight segment of the current flight.

In step 530, within the target aircraft class, and for each flight segment, the real-time transit time is compared with the median historic transit time. The real-time transit time and median historic transit time used for this comparison are derived according to step 520 above.

In step 540, the differential time for each flight segment is estimated from the comparison of the real-time transit time and the historic transit time for each flight segment, e.g. via the ETA calculation engine 140. The median historic transit time from step 520 is compared with the transit time of the current flight, for each flight segment. The differential transit time is a positive or negative percentage. Additional weight is given to the more recent historic transit times.

In step 550, the differential time is applied to the estimated transit time for each flight segment of the current flight path, e.g. via the ETA calculation engine 140. The estimated transit times are from step 440 above. The transit time for each flight segment is estimated based on the application of the differential time to each flight segment. For each flight segment, when there is a difference between the historic transit time and the real-time (current flight) transit time, the estimated transit time for the corresponding flight segment of the current flight is adjusted to reflect this difference, e.g. via the ETA calculation engine 140. So, the estimated transit time for each flight segment is adjusted on the basis of a differential time difference between the historical and real-time transit time.

For example, if previous historic flights had significantly longer or shorter transit times than the current flight, the estimated transit time for the current flight is adjusted accordingly. As an example, if current flight A traveled the previous 300-mile flight segment in a shorter transit time than the median historic transit times, then the current transit time estimates for the remaining flight segments are adjusted to be shorter, to reflect this increased current flight speed.

In step 560, the extended ETA (X-ETA) ON time is calculated for the current flight by adding together the estimated transit times for all of the flight segments from the current flight, e.g. via the ETA calculation engine 140. The estimated transit times were calculated in step 550.

In step 570, the estimated X-ETA IN time is calculated by adding the estimated ON time to the estimated ON to IN time, e.g. via the ETA calculation engine 140, according to the following formula:

$$\text{X-ETA IN time} = \text{Estimated ON time} + \text{Estimated ON to IN time} \quad \text{a.}$$

Initially, in step 570, the ON to IN time is estimated using a database look-up table function comprised of prior ON to IN times, e.g. via the ETA calculation engine 140. First, the ETA system 100 searches for past flights that match the conditions of the current flight, including time of day, runway, gate proximity, and time of year, etc. Second, the median past ON to IN time of the matching flights is calculated, e.g. via, the ETA calculation engine 140. In addition, recent historic flights are evaluated, e.g. via the ETA calculation engine 140, to determine the airport's recent on-time flight performance relative to the average airport performance. This determination is used to add or adjust the median ON to IN time according to the airport's recent flight performance. The adjusted median ON to IN time is added to the estimated ON time, to estimate the ETA IN time.

In step 580, the estimated transit time for each flight segment of the current flight is updated throughout the current flight, by applying adjusted differential times as additional real-time (current flight) transit times are received. Accordingly, the extended ETA ON and times for the current flight are also continuously updated as the estimated transit times for each flight segment are updated and calculated.

It should be noted that certain airport areas may have less structure in the arrival patterns. In order to accurately determine the airport arrival sequence in terminal areas that have less route structure between the arrival fix and the runway a density calculation may be used. The density calculation is based on a specific runway configuration that has been projected as the "in use" runway. This predicted or projected runway configuration has been described in detail above. Once the arrival runway has been projected the density algorithm may use a specific point called an "arrival runway entry point" (AREP) in space associated with the arrival runway traffic pattern. A calculation may then be used to determine the flying distance for each aircraft using its present position to the AREP. The arrival order at the AREP for the various aircraft is then determined by using speed/distance calculations. After the arrival order is predicted, the time remaining to the runway based the speed reductions needed to sequence the prioritized arrival over the AREP may be used to calculate the ON time.

To provide a specific example, the AREP may be considered to the Location D of FIG. 3 for a specific projected runway configuration. For each aircraft that is headed to the AREP (e.g., Location D), the flying distance to the AREP may then be determined. Based on this flying distance, the order of arrival at the AREP may be determined for the aircraft. It should be understood that other factors besides distance (e.g., flight speed, type of aircraft, etc.) may also be used to determine the order of arrival at the AREP. After the arrival order is predicted, the time remaining to the runway (e.g., Location E) based the speed reductions needed to sequence the prioritized arrival over the AREP may be used to calculate the ON time.

Figure 6:
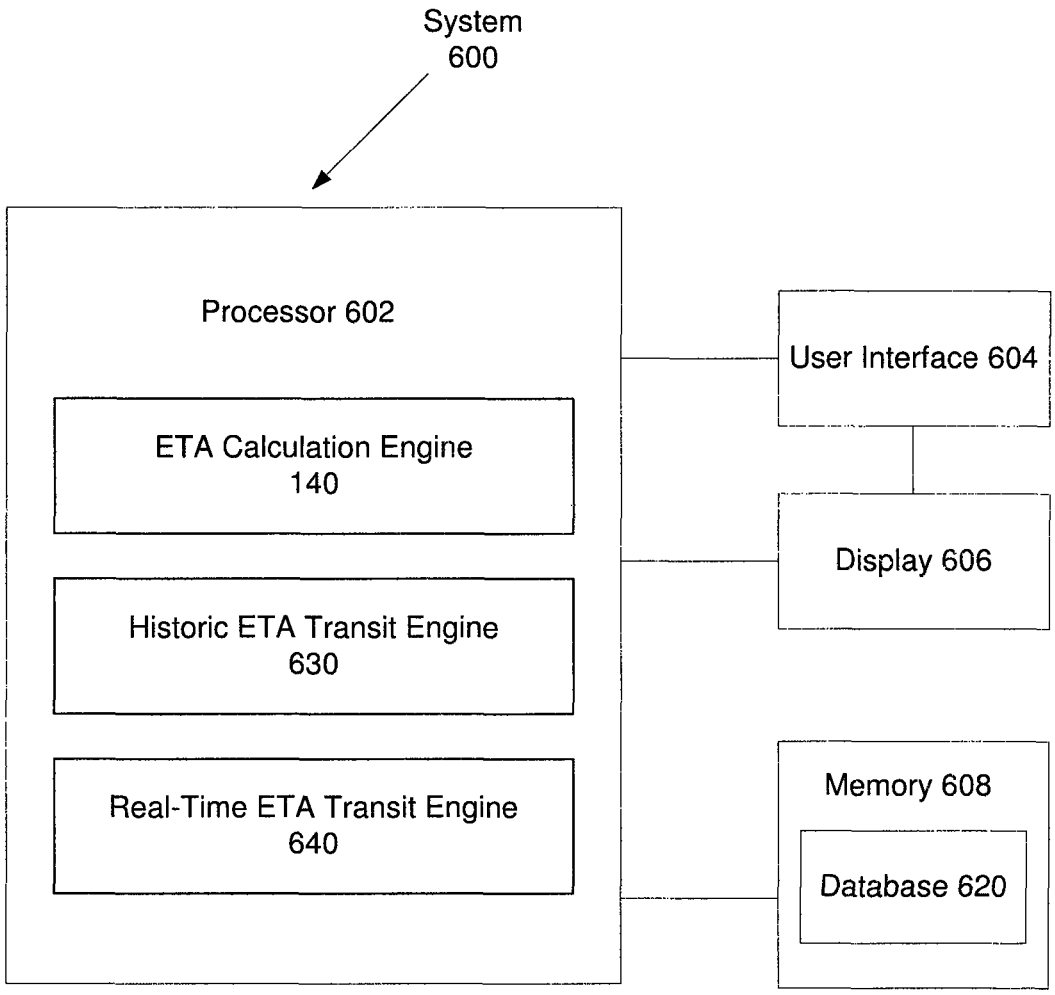
FIG. 6 shows an exemplary system for implementing an ETA system, such as the ETA system shown in FIG. 1.

FIG. 6 shows an exemplary system 600 for implementing an ETA system, such as ETA system 100 shown in FIG. 1. Those skilled in the art will understand that other types of systems may also be used to implement ETA systems and the system 600 is only exemplary. The system 600 comprises a processor 602, a user interface 604, a display 606, and a memory 608. The memory 608 includes a database 620. The database 620 may store the information that is used to calculate the ETA, the estimated historic transit time input 110, and real-time transit time input 120.

In this exemplary system 600, the processor 102 may be implemented with engines, including, for example, the ETA calculation engine 140, the Historic Transit Time engine 630 and the Real Time Transit Time engine 640. The ETA calculation engine 140 may perform the method 200 that was described above with reference to FIG. 2. The Historic Transit Time engine 630 may perform the method 400 that was described above with reference to FIG. 4. The Real Time Transit Time engine 640 may perform the method 500 that was described above with reference to FIG. 5. Again, it should be noted that the processor 102 performing these functions is only exemplary.

The user interface 604 may be used to manually input one or more of the condition inputs 130. Again, these condition inputs 130 may also be stored in the database 620. The display 606 may be used to display the ETAs for the various aircraft.

Those skilled in the art will understand that the above-described exemplary embodiments may be implemented in any suitable software or hardware configuration or combination thereof. An exemplary hardware platform for implementing the exemplary embodiments may include, for example, an Intel x86 based platform with compatible operating system, a Mac platform and MAC OS, etc. In a further example, the exemplary embodiments of the calculation engine may be a program containing lines of code stored on a non-transitory computer readable storage medium that, when compiled, may be executed on a processor.

It will be apparent to those skilled in the art that various modifications may be made in the present invention, without departing from the spirit or the scope of the invention. Thus, it is intended that the present invention cover modifications and variations of this invention, provided they come within the scope of the appended claims and their equivalent.

What is claimed is:

1. A method, comprising:

dividing a flight path of a current flight of an aircraft into flight segments, wherein the flight path comprises a route between an aircraft takeoff and a runway landing, wherein the aircraft is from a target aircraft class;

receiving historic transit time data of the target aircraft class for each flight segment of the current flight;

determining a historic transit time for each of the flight segments based on the historic transit time data;

receiving, during the current flight, a real-time transit time of the current flight of the aircraft for each of the flight segments of the current flight, wherein the real-time transit times are received when the aircraft has completed each respective flight segment;

determining a differential time for each completed flight segment by comparing the real-time transit time and the historic transit time, wherein the differential time is represented as a percentage;

applying the differential time to future flight segments to adjust an estimated transit time for each future flight segment, wherein future flight segments are flight segments of the current flight that have not yet been completed;

determining a time for arrival at an arrival order entry point (AREP) for the aircraft and at least one further aircraft;

determining an arrival order for the aircraft based on the AREP arrival times for the aircraft and the at least one further aircraft;

adjusting the estimated transit time for at least one flight segment based on the arrival order;

determining an estimated ON time for the aircraft by adding together all of the estimated transit times from each flight segment of the flight path;

receiving flight data indicating at least one flight segment comprises a holding loop;

performing data cleansing on the flight data to remove data noise from the flight data;

updating the estimated ON time based on the data cleansing;

determining an estimated IN time for the aircraft based on the estimated ON time and an estimated ON to IN time; and providing the estimated ON time and the estimated IN time to an output device for use by a user.

2. The method of claim 1, wherein the estimated ON time is determined based on at least one of weather, a flight route, air traffic controller actions, airport delays, a runway configuration, an airspace configuration, a flight trajectory, wind, a time of day, a day of week, airspace congestion, or FAA controlled factors.

3. The method of claim 1, wherein determining the historic transit time comprises matching forecast conditions for the aircraft to previously stored past performance transit times for similar conditions, based on a same day of week, a same time of day, and a same aircraft class.

4. The method of claim 3, wherein determining the historic transit time further comprises identifying runway configurations, an airspace capacity, and a runway capacity.

5. The method of claim 4, wherein determining the historic transit time further comprises determining an estimated ON time for the aircraft, based on the matched past performance transit times, the identified runway configurations, the identified airspace capacity, and the identified runway capacity.

6. The method of claim 2, wherein determining the historic transit time further comprises combining historic transit times according to statistical methods.

7. The method of claim 2, wherein the estimated ON time is updated by applying the adjusted differential time as additional real-time transit times are received.

8. The method of claim 1, further comprising:

for at least one of the segments:

determining the arrival runway entry point (AREP);

determining a flying distance from a present position of the aircraft to the AREP; and determining the arrival order for the aircraft at the AREP based on the flying distance.

9. A system, comprising:

an input receiving, during a current flight of an aircraft, a real-time transit time for the aircraft for each of a plurality of flight segments, wherein the aircraft is from a target aircraft class, wherein the real-time transit times are received when the aircraft has completed each respective flight segment;

an input receiving historic transit time data of the target aircraft class;

and a calculation engine configured for, dividing a flight path of the current flight into the flight segments, wherein the flight path comprises a route between an aircraft takeoff and a runway landing, determining a historic transit time for each of the flight segments based on the historic transit time data;

determining a differential time for each completed flight segment by comparing the real-time transit time and the historic transit time, wherein the differential time is represented as a percentage, applying the differential time to future flight segments to adjust an estimated transit time for each future flight segment, wherein future flight segments are flight segments of the current flight that have not yet been completed, determining an estimated ON time for the aircraft by adding together all of the estimated transit times from each flight segment of the flight path, determining a time for arrival at an arrival order entry point (AREP) for the aircraft and at least one further aircraft;

determining an arrival order for the aircraft based on the AREP arrival times for the aircraft and the at least one further aircraft;

adjusting the estimated transit time for at least one flight segment based on the arrival order;

receiving flight data indicating at least one flight segment comprises a holding loop;

performing data cleansing on the flight data to remove data noise from the flight data;

updating the estimated ON time based on the data cleansing;

determining an estimated IN time for the aircraft based on the estimated ON time and an estimated ON to IN time, and provide the estimated ON time and the estimated IN time to an output device for use by a user.

10. The system of claim 9, further comprising:

a data storage unit storing the historic transit time data, the real-time transit time for the aircraft, the determined differential time, and the estimated ON time for the aircraft.

11. The system of claim 9, wherein the determining of the historic transit time comprises combining historic transit times according to statistical methods.

12. The system of claim 10, wherein the calculation engine is further configured for determining the historic transit time by matching forecast conditions for the aircraft to past performance transit times for similar conditions previously stored in the data storage unit.

13. The system of claim 12, wherein the matching the forecast conditions to past performance is based on a same day of week, same time of day, and same aircraft class.

14. The system of claim 12, wherein determining the historic transit time comprises identifying runway configurations, an airspace capacity, and a runway capacity.

15. The system of claim 14, wherein determining the historic transit time comprises determining an estimated ON time for the aircraft, based on the matched past performance transit times, the identified runway configurations, the identified airspace capacity, and the identified runway capacity.

16. A non-transitory computer readable storage medium storing a set of instructions that are executable by a processor, the instructions being operable to cause the processor to:

divide a flight path of a current flight of an aircraft into flight segments, wherein the flight path comprises a route between an aircraft takeoff and a runway landing, wherein the aircraft is from a target aircraft class;

receive historic transit time data of the target aircraft class for each flight segment of the current flight;

determine a historic transit time for each of the flight segments based on the historic transit time data;

receive, during the current flight, a real-time transit time of the current flight of the aircraft for each of the flight segments of the current flight, wherein the real-time transit times are received when the aircraft has completed each respective flight segment;

determine a differential time for each completed flight segment by comparing the real-time transit time and the historic transit time, wherein the differential time is represented as a percentage;

apply the differential time to future flight segments to adjust an estimated transit time for each future flight segment, wherein future flight segments are flight segments of the current flight that have not yet been completed;

determine a time for arrival at an arrival order entry point (AREP) for the aircraft and at least one further aircraft;

determine an arrival order for the aircraft based on the AREP arrival times for the aircraft and the at least one further aircraft;

adjust the estimated transit time for at least one flight segment based on the arrival order;

determine an estimated ON time for the aircraft by adding together all of the estimated transit times from each flight segment of the flight path;

receive flight data indicating at least one flight segment comprises a holding loop;

perform data cleansing on the flight data to remove data noise from the flight data;

update the estimated ON time based on the data cleansing;

determine an estimated IN time for the aircraft based on the estimated ON time and an estimated ON to IN time, provide the estimated ON time and the estimated IN time to an output device for use by a user.

17. The non-transitory computer readable storage medium of claim 16, wherein the estimated ON time is determined based on at least one of weather, a flight route, air traffic controllers' actions, airport delays, a runway configuration, an airspace configuration, a flight trajectory, wind, a time of day, a day of week, airspace congestion, or FAA controlled factors.

18. The non-transitory computer readable storage medium of claim 16, wherein the set of instructions further cause the processor to:

match forecast conditions for the aircraft to previously stored past performance transit times for similar conditions, based on a same day of week, same time of day, and same aircraft class.

19. The non-transitory computer readable storage medium of claim 16, wherein the set of instructions further cause the processor to:

identify runway configurations, an airspace capacity, and a runway capacity for the matched forecast conditions.

20. The non-transitory computer readable storage medium of claim 19, wherein the set of instructions further cause the processor to:

determine an estimated ON time for the aircraft, based on the matched past performance transit times, the identified runway configurations, the identified airspace capacity, and the identified runway capacity.

* * * * *